United States Patent [19]

Lewis

[11] Patent Number: 4,799,477

[45] Date of Patent: Jan. 24, 1989

[54] REBREATHING MASK

[76] Inventor: Ralph H. Lewis, 3083 Highway 175, Lakeport, Calif. 95453

[21] Appl. No.: 172,751

[22] Filed: Mar. 28, 1988

[51] Int. Cl.[4] ..... A62B 18/02

[52] U.S. Cl. ..... 128/206.24; 128/206.21; 128/206.26; 128/205.25; 128/200.27

[58] Field of Search ..... 128/206.26, 200.27, 128/206.27, 206.28, 205.25, 200.28, 205.13, 205.18, 205.22, 206.21, 206.24, 206.25, 207.13, 206.23, 206.12, 206.14, 206.16, 207.12, 206.15, 206.23

[56] References Cited

U.S. PATENT DOCUMENTS 2,391,565 12/1945 Grindrod et al. ..... 128/205.25

3,330,273 7/1967 Bennett ..... 128/206.26

3,441,020 4/1969 Wortz et al. ..... 128/205.25

4,258,710 3/1981 Reber ..... 128/205.25

*Primary Examiner*—Edgar S. Burr

*Assistant Examiner*—Kimberly L. Asher

*Attorney, Agent, or Firm*—Ernest M. Anderson

[57] ABSTRACT

A face mask is disclosed for enclosing the nose and mouth of humans and defining an air chamber from which a human may inhale and exhale gases. The mask comprises an inflatable bladder that encircles the air chamber, the bladder having elliptical perforations that are spaced therearound to emit air from the bladder into direct surface contact with the face of the person wearing the mask. Means is also provided for introducing air into both the bladder and the air chamber.

3 Claims, 1 Drawing Sheet

REBREATHING MASK

SUMMARY OF THE INVENTION

This invention relates generally to breathing and rebreathing masks of the type used by firemen and persons working within a noxious or polluted environment. The invention herein described utilizes a mask construction having a bladder formed with perforations to emit air or other breathable gas therefrom into direct surface contact with the face of the person wearing the mask. The perforations are preferably elliptical in shape, the major axis of each perforation extending toward adjacent perforations, thus allowing the gas to be emitted in a substantially continuous stream directed against the face of the wearer and preventing seepage of ambient gases into the air chamber from which the wearer breaths.

A principal object of the invention is to provide an improved mask construction to prevent the seepage of noxious fumes into the breathing chamber of the mask.

Other objects of this invention will become apparent in the following detailed description.

In the drawings forming a part of this application and in which like parts are identified by like reference numerals throughout the same:

PRIOR ART MASK CONSTRUCTION

Figure 1:
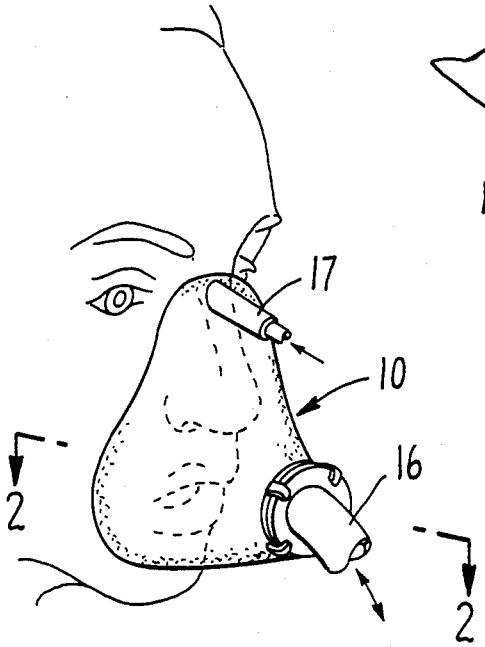
PRIOR ART FIG. 1.
FIG. 1 is a perspective view of a person wearing a mask constructed in the typical fashion of the prior art.
Figure 2:
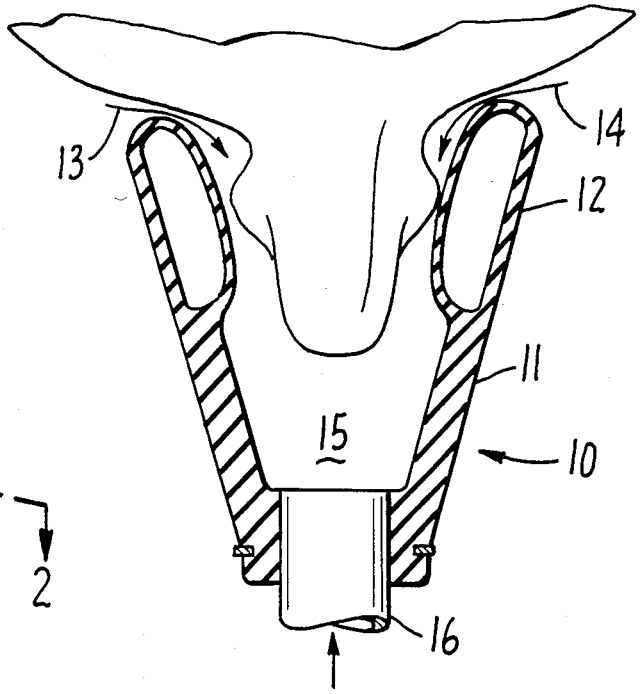
PRIOR ART FIG. 2.
FIG. 2 is a section taken on the line 2—2 of FIG. 2.

Referring to FIGS. 1 and 2 there is illustrated a conventional prior art mask construction for breathing and rebreathing air or oxygen from a bottled supply (not shown). The mask 10 comprises a flexible member 11 contoured to enclose the nose and mouth of humans. That portion of the mask closest to the face of the wearer is formed with an inflatable bladder 12. The purpose of the bladder is to provide sufficient resiliency and elasticity that the mask will accommodate and adjust to various contours of the face, allowing the mask to be worn by persons having different facial contours. Notwithstanding, this prior art construction does little to prevent the seepage of noxious gas and pollutant fumes (as shown by the lines 13 and 14) into the breathing chamber 15 when the wearer of the mask quickly inhales.

It is to be understood that the wearer of mask 10 inhales gases from chamber 15 and a breathable gas is fed into the chamber 15 through a conduit 16. Bladder 12 is inflated through a conduit 17 which may be sealed or connected to the same source of breathable gas as conduit 16.

Air or oxygen is ordinarily fed into chamber 15 under 14 centimeters of water pressure, or 2.39 psig. However the pressure within chamber 15 is suddenly reduced upon inhaling by the mask wearer, and it is not unusual that the pressure will be reduced by 3 centimeters of water pressure or more. This sudden drop in pressure within chamber 15 allows the seepage or introduction of noxious fumes between the bladder 12 and the face of the wearer.

Figure 3:
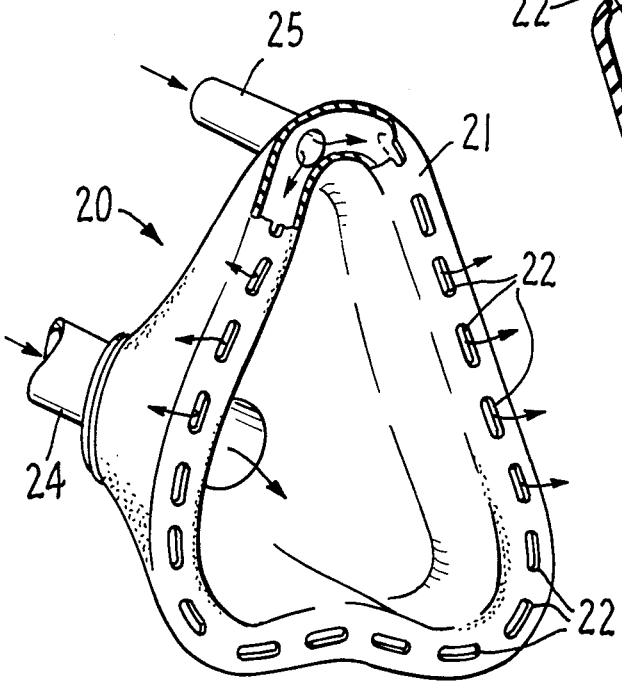
FIG. 3 is a perspective view of the improved mask construction that embodies this invention.
Figure 4:
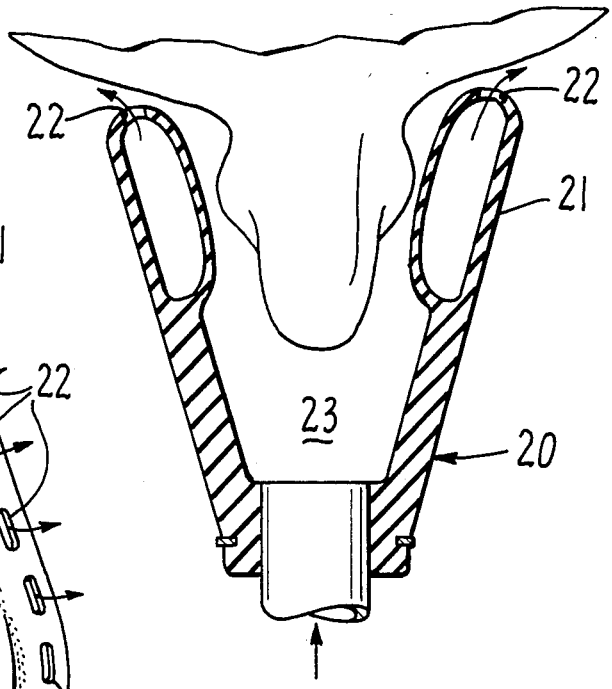
FIG. 4 is a section like that of FIG. 2 but illustrating the improved air flow and air barrier that is formed with the mask construction of FIG. 3.

Referring to FIGS. 3 and 4, there is shown an improvement in a mask construction wherein a mask 20 comprises an inflatable bladder 21 formed with the plurality of perforations 22 which are spaced therearound to emit air from the bladder into direct surface contact with the face of the wearer. Breathable gas is introduced into mask chamber 23 through a conduit 24, and bladder 21 is connected to a source of breathable gas by a conduit 25.

Bladder 21 is similar to that of the prior art in having a nose portion that extends across the bridge of the nose and a mouth portion that extends beneath the mouth of the wearer. Unlike the prior art however, perforations 22 allow air to escape from bladder 21 and form a gas barrier that prevents the seepage of noxious gas between the face of a wearer and the bladder upon inhalation.

The size of perforations 22 may vary depending on the section or portion of the bladder and its contour. In those areas where the contour changes abruptly, it is desirable to use smaller perforations to provide the most desirable air barrier. As an example those portions of the bladder which extend across the bridge of the nose may be formed with perforations smaller than those which extend in a substantially straight line as beneath the mouth of the wearer.

Bladder 21 is preferably maintained under a pressure less than that introduced into chamber 23 but greater than the chamber pressure during inhalation. Assuming the gas pressure applied through conduit 24 is approximately 2.9 psig, the pressure within bladder 21 should be maintained at approximately 1.7 psig or greater.

Although a preferred embodiment of the invention is illustrated and described, various modifications and changes may be resorted to without departing from the spirit of the invention of the scope of the appended claims and, each of such modifications and changes is contemplated. As an example, the face mask may define a breathing chamber that encompasses the eyes and brow of the wearer as well as the nose and mouth.

What is claimed is:

1. A face mask for enclosing the nose and mouth of humans and defining a chamber from and into which a person may inhale and exhale gases comprising:

an inflatable bladder that encircles the chamber;

means for providing a substantially continuous barrier of breathable gas from said bladder, to surround the chamber, said means comprising perforations formed in said bladder and spaced therearound, certain of said perforations being elliptical in shape, the major axis of each elliptical perforation extending generally toward the major axis of adjacent perforations; and means for introducing a breathable gas into said chamber and said bladder, the breathable gas introduced into said bladder escaping through said perforations to provide said substantially continuous barrier of breathable gas.

2. The face mask of claim 1, and further comprising means for introducing a breathable gas into said bladder under pressure that is less than the breathable gas introduced into the chamber but greater than the pressure within the chamber during inhalation by the person wearing the mask.

3. The face mask of claims 1 or 2, and further comprising means for introducing a breathable gas into said bladder under a pressure of approximately 1.7 psig or greater.

* * * * *